US005222527A

United States Patent [19]

Painter et al.

[11] Patent Number: 5,222,527

[45] Date of Patent: Jun. 29, 1993

[54] HARNESS CABLE SYSTEM FOR A LOOM

[75] Inventors: Lee O. Painter, Tigerville; John H. Roddenberry, Greenville, both of S.C.

[73] Assignee: The Springfield Company, Inc, Greenville, S.C.

[21] Appl. No.: 782,089

[22] Filed: Oct. 24, 1991

[51] Int. Cl.[5] ..... D03C 13/00

[52] U.S. Cl. ..... 139/83; 139/88

[58] Field of Search ..... 24/129 R, 129 A, 129 W; 139/87, 88, 82, 83, 84, 89, 90, 85, 55.1, 29

[56] References Cited

U.S. PATENT DOCUMENTS

| | | | |
|---|---|---|---|
| 11,324 | 1/1871 | Crompton | 139/83 |
| 733,660 | 7/1903 | Knibbs et al. | 139/88 |
| 901,927 | 10/1908 | Withee et al. | 139/82 |
| 1,828,058 | 10/1931 | Maynard | 139/88 |
| 2,983,976 | 5/1961 | Ehmann | 24/129 W |
| 3,082,500 | 3/1963 | Moreau | 24/129 W |

FOREIGN PATENT DOCUMENTS

| | | | |
|---|---|---|---|
| 483677 | 4/1938 | United Kingdom | 139/88 |
| 627819 | 8/1949 | United Kingdom | 139/88 |

*Primary Examiner*—Andrew M. Falik
*Attorney, Agent, or Firm*—Ralph Bailey

[57] ABSTRACT

A loom harness cable, extending from an operating mechanism on one end and beneath the loom for connection adjacent an end of the harness remote from the operating mechanism, is disconnectably joined in segments by turnbuckles (C and D) to save the time of skilled personnel, machine downtime, as well as material, in repairing a broken harness cable.

4 Claims, 1 Drawing Sheet

HARNESS CABLE SYSTEM FOR A LOOM

BACKGROUND OF THE INVENTION

This invention relates to an improvement in harness cables for use on Dobby looms wherein the harness cables are segmented to facilitate repair of breakages.

It has heretofore been necessary to replace entire harness cables when breakages occur therein. Replacement is expensive both because of the necessity to replace the entire cable and because of the labor involved. The new cable must be installed making connections in each end while passing the cable beneath the loom past several guides and thence upwardly for connection adjacent an end of the harness remote from the Dobby head. Since a high level of skill is required in breaking or replacing broken or excessively worn cables, skilled personnel must perform the replacement operation at considerable additional expense. The replacement is further complicated by difficulty in securing the correct placement and tensions in the cable.

Accordingly, it is an important object of this invention to provide a segmented harness cable which may be replaced in segments depending upon where the break has occurred.

Another important object of the invention is to reduce machine downtime in replacing broken harness cables.

Another important object of the invention is to save labor in the replacement of broken harness cable components by reducing both the time and the degree of skill involved.

Still another important object of the invention is the provision of a segmented harness cable having adjustment locations which are disconnectable so that connections to the harness cable need only be made at one end and an intermediate portion to replace a broken segment.

SUMMARY OF THE INVENTION

A loom harness cable extends from an operating mechanism on one end and beneath the loom for connection adjacent an end of the harness remote from the operating mechanism. The harness cable is adjustably and disconnectably joined in three segments by turnbuckles to save the time of skilled personnel, machine downtime, as well as material, in repairing a broken harness cable.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figures 1, 2:
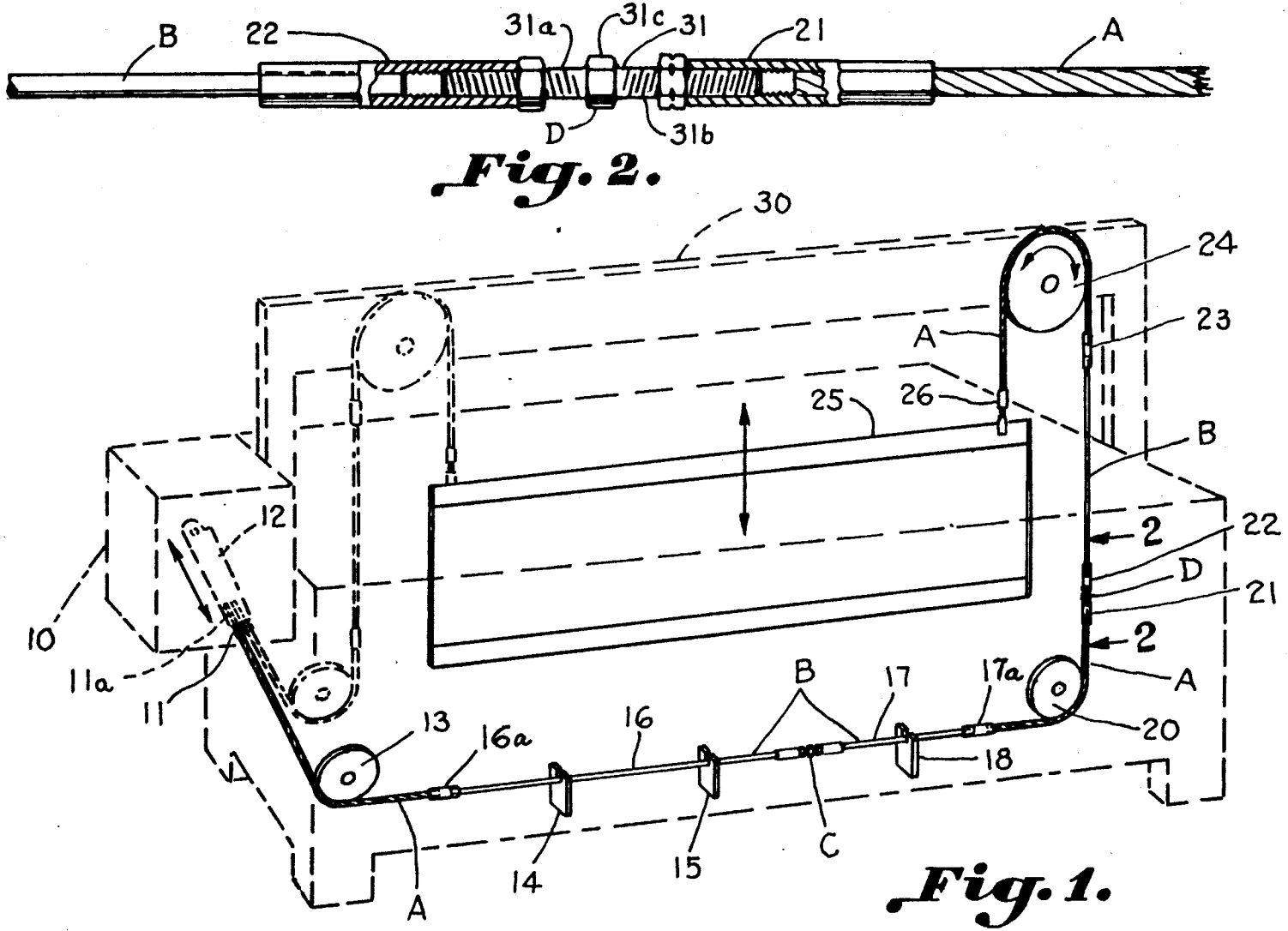
FIG. 1 is a schematic perspective view illustrating a harness cable constructed in accordance with the present invention installed upon a loom having a Dobby head.
FIG. 2 is a longitudinal sectional elevation taken on the line 2—2 in FIG. 1.

The drawing illustrates a harness cable for use on a loom connected on one end to an operating mechanism for imparting oscillatory motion thereto. The harness cable extends downwardly on one side of the loom and on one side of a harness as seen in FIG. 1 over a sheave, thence passing in a substantially horizontal beneath the loom and completely beneath the harness as seen in said figure, thence over a sheave and upwardly on an opposite side of the loom, thence over a sheave and downwardly for attachment on an adjacent end of a harness. A flexible cord section A passes about each sheave. A rigid wire connector B extends between the flexible cord sections. A first turnbuckle C interposed in the horizontal run beneath the loom adjustably and disconnectably joins the harness cable at each end thereof. A second turnbuckle D adjustably and disconnectably joins the harness cable between the second and third sheaves. Thus, time consumed in repairing a broken harness cable and materials expended therein are greatly reduced since connection need be made to the loom on only one end, only a single segment of the harness cable where the break occurred need be replaced, and connection made in a convenient location or locations of the harness cable. Preferably the harness cable is separated into three segments.

While the embodiment of the invention described herein is illustrated in connection with a Staubli Dobby head suitable for use on a Picinol loom, the harness cord may be adapted for use in connection with other loom and attachment constructions.

Referring more particularly to FIG. 1, the Dobby head is illustrated in broken lines as at 10, and the harness cord has a link 11 on one end which is threaded at **11*a* for attachment to operating mechanism 12 of the Dobby head for imparting an oscillatory motion to the harness cable. A first flexible cord section A of the harness cable passes about a sheave 13 and thence past guide members 14 and 15 to the first turnbuckle C. The turnbuckle C is connected to the wire connector B which is divided by the turnbuckle into two segments 16 and 17. The segment 16 is connecting as by swaging to a fitting 17** where it is joined to the flexible cord section A.

The rigid wire connector segment **16*a* is positioned in respect to the guide 18 and connected as by swaging to the fitting 17*a* to a cord section A for passing over a sheave 20. The cord section A passes upwardly where it is connected to the turnbuckle D on one end as by swaging to the fitting 21. A fitting 22 is connected as by swaging on the other end to wire connector B. The wire connector B is connected as by the fitting 23 to the cord section A for passing over a sheave mechanism 24 for fastening to an adjacent end of the harness 25 by means of the connector 26. It will be observed that the sheave 24 is carried by the loom together with other sheave components described herein. The loom is illustrated in broken lines at 30**.

The turnbuckle C is similar to the turnbuckle D. The turnbuckle D is illustrated in FIG. 2 as including the swaged connecting fixtures 21 and 22 and an intermediate threaded member 31 which has threaded ends as at **31*a* and 31*b* for being axially received within the connecting fixtures 21 and 22 by threads of opposite hand. A nut 31*c*** forms a central portion of the turnbuckle for tightening the connection between segments of the harness cord and for permitting adjustments in tension between the components.

It is thus seen that an improved harness cable has been provided wherein adjustments may be made at accessible locations. Since the cable may be replaced in case of breakage in segments, it is possible to position connecting points at accessible locations in respect to the other loom components to reduce labor and machine downtime.

While a preferred embodiment of the invention has been described using specific terms, such description is for illustrative purposes only, and it is to be understood that changes and variations may be made without departing from the spirit or scope of the following claims.

What is claimed is:

1. In a loom including at least one harness and a harness cable system therefor wherein the improvement comprises: the harness cable system connected on one end to an operating mechanism for imparting oscillatory motion thereto and extending downward on one side of the loom on one side of the harness over a first sheave, thence passing in a substantially horizontal run beneath the loom, thence over a second sheave and upwardly on an opposite side of the loom on the other side of said harness, thence over a third sheave and downwardly for attachment on an adjacent end of said harness:

first, second and third flexible cord sections passing respectively about each of said first, second and third sheaves;

a first rigid wire connector extending between said first and second flexible cord sections forming a substantially horizontal run extending entirely beneath said harness;

a first turnbuckle interposed in said horizontal run beneath the loom including means for adjustably and disconnectably joining said first rigid wire connector beneath said loom;

a second rigid wire connector extending between said second and third flexible cord sections; and a second turnbuckle including means for adjustably and disconnectably joining said second flexible cord section and said second rigid wire connector;

whereby time consumed in repairing a broken harness cable and materials expended therein are greatly reduced since connection need be made to the loom on only one end, only a single segment of the harness cable where the break occurred need be replaced, and connection made in a convenient location or locations of the harness cable.

2. In a loom including at least one harness and a harness cable system therefor wherein the improvement comprises: the harness cable system connected on one end to an operating mechanism for imparting oscillatory motion thereto and extending downward on one side of the loom on one side of the harness over a sheave, thence passing in a substantially horizontal run beneath the loom, thence over a sheave and upwardly on an opposite side of the loom on the other side of said harness, thence over a sheave and downwardly for attachment on an adjacent end of said harness;

a flexible cord section passing about each sheave;

a rigid wire connector extending between said flexible cord sections extending entirely beneath said harness; and a turnbuckle interposed in and including means for disconnectably joining said harness cable system;

whereby time consumed in repairing a broken harness cable and materials expended therein are greatly reduced since connection need be made to the loom on only one end, only a single segment of the harness cable where the break occurred need be replaced, and connection made in a convenient location or locations of the harness cable.

3. The harness cable system set forth in claim 2 wherein said turnbuckle includes swaged connecting fixtures and an intermediate member threadably received in said fixtures.

4. The harness cable system set forth in claim 3 wherein said turnbuckle further includes a nut for tightening a connection between harness cord segments and for permitting adjustments in tension between components of said harness cable system.

* * * * *